United States Patent [19]

Smith

[11] Patent Number: 5,004,100

[45] Date of Patent: Apr. 2, 1991

[54] GOLF CLUB AND BAG SECURITY DEVICE

[76] Inventor: Donald E. Smith, 8325 Leeds St., Downey, Calif. 90242

[21] Appl. No.: 503,703

[22] Filed: Apr. 3, 1990

[51] Int. Cl.[5] ..... A63B 55/00; A63B 57/00

[52] U.S. Cl. ..... 206/315.2; 206/315.3; 70/19

[58] Field of Search ..... 206/315.2–315.8; 70/19

[56] References Cited

U.S. PATENT DOCUMENTS

| | | | |
|---|---|---|---|
| 1,570,510 | 1/1926 | McQuirk | 206/315.4 |
| 1,717,959 | 6/1929 | Cauffman | 206/315.6 |
| 1,770,060 | 7/1930 | Barlow | 206/315.6 |
| 1,788,478 | 1/1931 | Beaty et al. | 206/315.6 |
| 1,908,998 | 5/1933 | Mullins | 206/315.4 |
| 1,928,922 | 10/1933 | Adams | 206/315.4 |
| 4,538,728 | 9/1985 | Lewis | 206/315.3 |
| 4,863,019 | 9/1989 | Lewis et al. | 206/315.3 |

*Primary Examiner*—William I. Price
*Attorney, Agent, or Firm*—Baker & McKenzie

[57] ABSTRACT

A device for securing a set of golf clubs in a bag is disclosed, in which a flat plate is provided having four generally parallel tongues defining three slots which are closed at one end of the plate and open at the opposite end. Each slot is slightly wider than a narrow region of the golf club shafts, and is substantially longer than its width, so that a group of golf clubs can be laterally inserted in series. A generally U-shaped arm is pivotally attached at one of its ends to one of the two outermost tongues, so as to be pivotable between an open position, in which clubs can be inserted in the slots, and an engaged position in which the arm closes the slot openings, securing the clubs in the device. Holes are provided in the other end of the arm and the other one of the plate's outermost tongues, which overlap when the plate and arm are in the engaged position, allowing a padlock shackle to lock the two pieces together. One end of a long cable is attached to the plate, the other end having a loop which hangs free when the device is not in use. The device may thus be locked to another object, such as a tree or pole, by wrapping the cable around the object and connecting the loop and the two overlapping ends of the device with the padlock shackle.

23 Claims, 1 Drawing Sheet

GOLF CLUB AND BAG SECURITY DEVICE

BACKGROUND OF THE INVENTION

This invention relates to security devices for protecting golf clubs and golf club bags from tampering or theft and, more particularly, to a novel and effective device for securing golf clubs in a golf club bag, which device is simple, lightweight, and small enough to be stored in a pocket of the bag when not in use.

Theft of golf clubs from unattended golf bags at public golf courses or country clubs has unfortunately been common through the years. Various devices have been designed to prevent the removal of golf clubs from golf bags under such circumstances, with varying degrees of success and convenience.

It is well known to provide a cover designed to fit over the mouth of a golf bag and completely enclose the golf clubs therein, with the cover locking in some manner to prevent theft of the clubs. Examples of such devices may be found in U.S. Pat. Nos. 1,570,510 (McQuirk); 1,928,922 (Adams); and 1,908,998 (Mullins). Because the covers are typically made of cloth or leather, these devices are easily cut open to allow removal of golf clubs.

Other devices having a plurality of holes through which individual golf club shafts may extend are shown in U.S Pat. Nos. 1,770,060 (Barlow); and 1,717,959 (Cauffman). However, these devises are awkward to use and severely restrict access to the inside of the bag.

Another form of security device, shown in U.S Pat. No. 4,538,728 (Lewis), comprises a two piece pivoting arrangement which attaches to the mouth of a golf club bag and provides a single hole in its center for encircling the shafts of a group of golf clubs at the narrow region near the golf club head. This design is only capable of securing a specific number of golf clubs, since the clubs can easily be removed if the single hole is not tightly packed.

In addition, the devices described above are only designed to retain golf clubs in their bag. It is still possible for thieves to remove the bag and clubs together to a remote location, at which the security devices can be defeated and the clubs removed.

OBJECTS OF THE INVENTION

Broadly, it is an object of this invention to provide an easy to use, effective security device for golf clubs and bag in which the drawbacks and disadvantages mentioned above are avoided or minimized.

It is a further object to provide such a device which is easy and inexpensive to manufacture.

It is another object to provide a compact, lightweight device which can easily be removed and stored in a pocket of the golf club bag, to permit unencumbered access to the mouth and interior of the bag.

It is yet a further object to provide a device which enables the user to lock the clubs and bag to another object such as a pole, tree or golf club cart.

These and other objects and advantages, which will be apparent to the reader, are achieved by the device described in the following specification and accompanying drawings.

SUMMARY OF THE INVENTION

In accordance with an illustrative embodiment of the present invention, a device and method are provided for securing a plurality of golf clubs in a bag having an open mouth for insertion of clubs therein, each of the golf clubs having a head disposed at the end of a shaft which is narrow in a region near the head and wider in a region further from the head. The device has a plate and arm shaped for cooperative engagement so that, when arranged in an engaged position, portions of their respective perimeters mutually define a through-cut slot closed at each end for securing the club shafts. The length of this slot is substantially greater than its width, and the width of the slot is greater than a single club's narrow region and less than a single club's wider region, so that a number of club shafts can be laterally enclosed by the slot and secured from lengthwise removal since the portions of the club on either side of the slot are larger than the slot width. The plate and arm each have a first connecting portion and a second connecting portion which permit the device to be opened so as to enable lateral insertion of the club shafts in the slot, and then closed and locked so as to secure the shafts therein.

In one form of security device embodying the invention, a flat plate is provided having four generally parallel tongues defining three slots which are closed at one end of the plate and open at the opposite end. Each slot is slightly wider than the narrow region of the golf club shaft, and approximately fifteen times longer than its width, so that a group of golf clubs can be laterally inserted in series. A generally U-shaped arm is pivotally attached at one of its ends to one of the two outermost tongues, so as to be pivotable between an open position, in which clubs can be inserted in the slots, and an engaged position in which the arm closes the slot openings, securing the clubs in the device. Holes are provided in the other end of the arm and the other one of the plate's outermost tongues, which overlap when the plate and arm are in the engaged position, allowing a padlock shackle to lock the two pieces together. One end of a long cable is attached to the plate, the other end having a loop which hangs free when the device is not in use. The device may thus be locked to another object, such as a pole, by wrapping the cable around the pole and connecting the loop and the two overlapping ends of the device with the padlock shackle.

DESCRIPTION OF A PREFERRED EMBODIMENT

Figure 1:
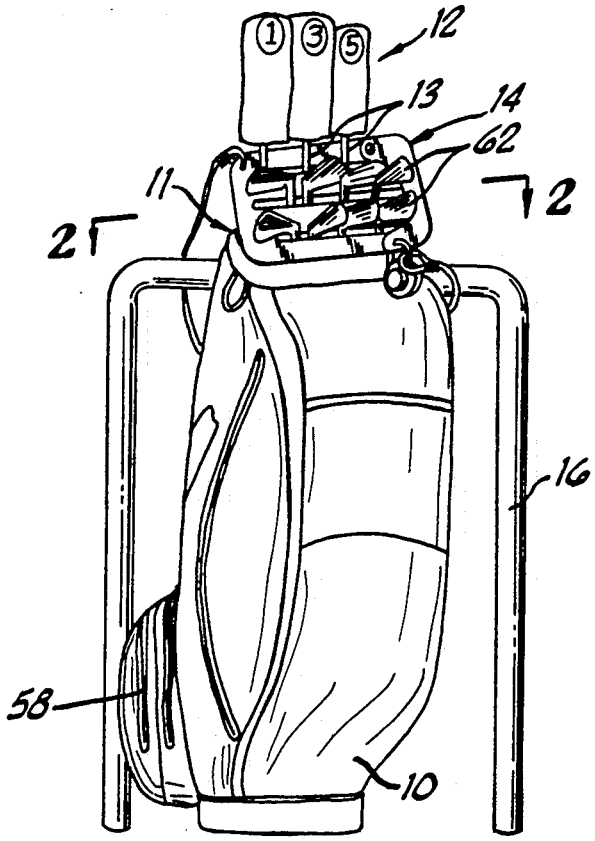
FIG. 1 is a perspective view showing a security device according to the present invention, securing a golf club bag and a set of clubs to a pole.

Referring now to the details of the drawings, FIG. 1 is a perspective view of a generally tubular golf club bag 10 with an open mouth 11. A set of golf clubs 12 is disposed in the bag with their shafts 13 extending down through the open mouth. A security device 14 is shown, in accordance with the present invention, securing the bag and clubs to a stationary pole 16.

Figure 2:
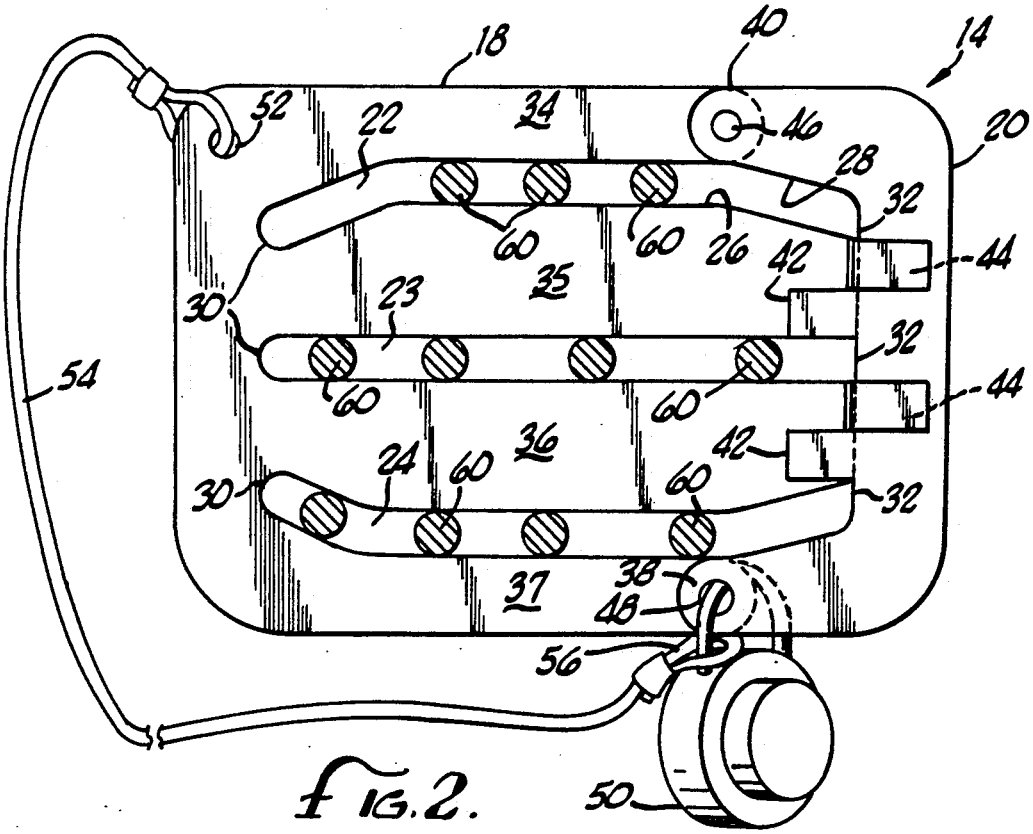
FIG. 2 is a plan view along line 2—2 of FIG. 1, showing overlapping portions of the security device in phantom.

FIG. 2 is an enlarged plan view of the security device 14 of FIG. 1, illustrating the device in a closed, or engaged position. In this position security device 14 comprises a flat, generally rectangular unit formed by the cooperative engagement of plate 18 and arm 20, which mutually define three through-cut slots 22–24 along portions of their respective perimeters 26 and 28, the slots being closed at each of their respective ends 30 and 32.

Plate 18 comprises a flat, rigid piece having four tongues 34–37 connected at one end of the plate and extending therefrom so as to define the main portions of slots 22–24. Arm 20 comprises a flat, rigid, generally U-shaped piece which joins the two outermost tongues 34 and 37 of plate 18 at first and second connecting portions 38 and 40 when the security device is engaged. Arm 20 also includes two tabs 42, extending from the inner perimeter of the U, which interconnect with two corresponding tabs 44 on the recessed tips of tongues 35 and 36, to prevent these tongues from being pryed away from the arm when the security device is engaged.

Connecting portions 38 and 40 may be connected in any of numerous well known arrangements designed to permit separation of the plate 18 and arm 20 for insertion or removal of clubs, and to lock securely in the engaged position when the device is in use. In the device shown, the plate and arm are permanently joined at the second connecting portion 40 by a rivet 46, permitting the plate and arm to pivot thereabout between an open position in which slots 22–24 are able to laterally receive golf club shafts, and the engaged position shown. Overlapping holes 48 are provided in the plate and arm at the first connecting portion 38, to receive the shackle of a padlock 50 for releaseably locking the device in the engaged position.

Another hole 52 is provided in a corner of the plate for attaching one end a steel cable 54, which may be used to secure the device to another object such as pole 16. The other end of the cable has an open loop 56 for receiving the shackle of padlock 50 after the cable has been wrapped around the pole, so as to lock the cable 54 and first connecting portions 38 together as shown in FIG. 1.

In the preferred embodiment, the plate and arm are formed of a hard, lightweight material, such as a molded thermoset polycarbonate plastic or an aluminum plate. The plate and arm form a rectangle ten inches long, seven inches wide, and ¼–⅜ inches thick. This size is large enough to hold a full set of golf clubs, and yet compact enough to fit inside the zippered pockets 58, on the outside of most golf club bags, when not in use. Cable 54 is five feet long, enabling it to extend around most poles, trees or other bulky objects. Slots 22–24 are eight inches long by 7/16 inches wide, to accommodate tapered golf club shafts having a narrow region 60 near head 62 of ⅜ inch diameter or less, and a wider region toward the grip (not shown) of ½ inch diameter or more. Since the golf club heads and the wider region toward the grips are substantially larger than the slot width, it is impossible to remove the shafts out of their respective slots in a lengthwise direction when the device is locked around the narrow region of the club shafts.

It will be understood that the foregoing description only sets forth one form of the invention, and that other embodiments will be readily apparent to those of ordinary skill in the art. For example, the first connecting portions 38 may be provided with integral locking means in place of padlock 50 and holes 48. The slots may be of a different configuration or number, so long as the widest point is smaller than the head of the club and the wider region of the shaft. Further, the arm may be connected to the plate by other means than rivet 46, and need not be permanently affixed to the plate, although this is believed to be a more convenient arrangement.

Accordingly, it will be appreciated that the security device described above is for purposes of illustration only, and that the various structural and operational features disclosed are susceptible to a number of modifications and changes, none of which entail any departure from the spirit and scope of the present invention as defined in the appended claims.

I claim:

1. A security device for releasably securing a plurality of golf clubs therein, each golf club having a head disposed at the end of a shaft, the shaft having a narrow region near the head and a wider region farther from the head, the device comprising:

a plate and arm shaped for cooperative engagement so that, when arranged in an engaged position, portions of their respective perimeters mutually define a through-cut slot closed at each end for securing the club shafts, the length of the slot being substantially greater than its width and the width of the slot being greater than a single club's narrow region and less than a single club's wider region;

said plate and arm each having a first connecting portion and a second connection portion, said first connecting portions each having a hole defined therein for receiving a padlock shackle and aligned in opposed relationship with the hole of the other when said plate and arm are arranged in said engaged position;

said plate comprising a plurality of tongues connected at one end of the plate and extending therefrom so as to define a number of said slots equal to one less than the number of tongues, said arm connecting the ends of at least two of said tongues when arranged in said engaged position; and means for joining said second connecting portions when said plate and arm are arranged in said engaged position.

2. A security device according to claim 1, said plate having a shape substantially conforming to the open mouth of a golf club bag, and said first and second connecting portions of said plate being located on the outermost two of said tongues.

3. A security device according to claim 1, in which said joining means comprises a fastener joining said plate and arm at said second connecting portion and permitting pivotal movement thereabout between said engaged position and an open position in which the slot-defining portions of said plate and arm are separated, so as to enable insertion or removal of the clubs therein.

4. A security device according to claim 3, further comprising a cable permanently attached thereto at one of its ends and having a loop at its other end for receiving a padlock shackle, said cable being substantially longer than the distance from said one end to said first connecting portions, whereby the cable may be wrapped around a fixed object and attached to said first connecting portions by the padlock.

5. A security device according to claim 4, wherein said arm connects the ends of each of said tongues.

6. A security device according to claim 2, wherein said plurality of tongues includes at least one tongue between said two outermost tongues, and wherein said arm and said at least one tongue include members which interlock when said plate and arm are arranged in said engaged position.

7. A device for releasably securing a plurality of golf clubs therein, each golf club having a head disposed at the end of a shaft, the shaft having a narrow region near the head and a wider region farther from the head, the device comprising:

a plate and arm shaped for cooperative engagement so that, when arranged in an engaged position, portions of their respective perimeters mutually define a through-cut slot closed at each head for securing the club shafts, the length of the slot being substantially greater than its width and the width of the slot being greater than a single club's narrow region and less than a single club's wider region;

said plate and arm each having a first connecting portion and a second connecting portion, said first connecting portions comprising locking means for releasably locking said first connecting portions together when said plate and arm are arranged in said engaged position;

said plate comprising a plurality of tongues connected at one end of the plate and extending therefrom so as to define a number of said slots equal to one less than the number of tongues, said arm connecting the ends of at least two of said tongues when arranged in said engaged position; and means for joining said second connecting portions when said plate and arm are arranged in said engaged position.

8. A security device according to claim 7, said plate having a shape substantially conforming to the open mouth of a golf club bag, and said first and second connecting portions of said plate being located on the outermost two of said tongues.

9. A security device according to claim 8, in which said joining means comprises a fastener joining said plate and arm at said second connecting portion and permitting pivotal movement thereabout between said engaged position and an open position in which the slot-defining portions of said plate and arm are separated, so as to enable insertion or removal of the clubs therein.

10. A security device according to claim 9, further comprising a cable permanently attached thereto at one of its ends and having a loop at its other end for receiving said locking means, said cable being substantially longer than the distance from said one end to said first connecting portions, whereby the cable may be wrapped around a fixed object and attached to said first connecting portions by the locking means.

11. A security device according to claim 10, wherein said arm connects the ends of each of said tongues.

12. A security device according to claim 8, wherein said plurality of tongues includes at least one tongue between said two outermost tongues, and wherein said arm and said at least one tongue include members which interlock when said plate and arm are arranged in said engaged position.

13. In combination with a generally tubular golf club bag having an open mouth at one end thereof and a plurality of golf clubs disposed in said bag and extending through said open mouth, each golf club having a head disposed at the end of a shaft, the shaft having a narrow region near the head and a wider region farther from the head, a security device arranged in an engaged position about the shafts of said clubs between their respective heads and wider regions, said security device comprising:

a plate and arm shaped for cooperative engagement so that, when arranged in said engaged position, portions of their respective perimeters mutually define a through-cut slot closed at each end for securing the club shafts, the length of the slot being substantially greater than its width and the width of the slot being greater than a single club's narrow region and less than a single club's wider region;

said plate and arm each having a first connecting portion and a second connecting portion, said first connecting portions comprising locking means for releasably locking said first connecting portions together when said plate and arm are arranged in said engaged position;

said plate comprising a plurality of tongues connected at one end of the plate and extending therefrom so as to define a number of said slots equal to one less than the number of tongues, said arm connecting the ends of at least two of said tongues when arranged in said engaged position; and means for joining said second connecting portions when said plate and arm are arranged in said engaged position.

14. A security device according to claim 13, said plate having a shape substantially conforming to the open mouth of said golf club bag, and said first and second connecting portions of said plate being located on the outermost two of said tongues.

15. A security device according to claim 14, in which said joining means comprises a fastener joining said plate and arm at said second connecting portion and permitting pivotal movement thereabout between said engaged position and an open position in which the slot-defining portions of said plate and arm are separated, so as to enable insertion or removal of the clubs therein.

16. A security device according to claim 15, further comprising a cable permanently attached thereto at one of its ends and having a loop at its other end for receiving said locking means, said cable being substantially longer than the distance from said one end to said first connecting portions, whereby the cable may be wrapped around a fixed object and attached to said first connecting portions by the locking means.

17. A security device according to claim 16, wherein said arm connects the ends of each of said tongues.

18. A security device according to claim 14, wherein said plurality of tongues includes at least one tongue between said two outermost tongues, and wherein said arm and said at least one tongue include members which interlock when said plate and arm are arranged in said engaged position.

19. A security device for releasably securing a plurality of golf clubs therein, each golf club having a head disposed at the end of a shaft, the shaft having a narrow region near the head and a wider region farther from the head, the device comprising:

a plate and arm shaped for cooperative engagement so that, when arranged in an engaged position, portions of their respective perimeters mutually define a through-cut slot closed at each end for securing the club shafts, the length of the slot being substantially greater than its width and the width of the slot being greater than a single club's narrow region and less than a single club's wider region;

said plate and arm each having a first connecting portion and a second connecting portion, said first connecting portions each having a hole defined therein for receiving a padlock shackle and aligned in opposed relationship with the hole of the other when said plate and arm are arranged in said engaged position;

means for joining said second connecting portions when said plate and arm are arranged in said engaged position; and a cable permanently attached at one of its ends to the security device and having a loop at its other end for receiving a padlock shackle, said cable being substantially longer than the distance from said one end to said first connecting portions, whereby the cable may be wrapped around a fixed object and attached to said first connecting portions by the padlock.

20. A device for releasably securing a plurality of golf clubs therein, each golf club having a head disposed at the end of a shaft, the shaft having a narrow region near the head and a wider region farther from the head, the device comprising:

a plate and arm shaped for cooperative engagement so that, when arranged in an engaged position, portions of their respective perimeters mutually define a through-cut slot closed at each end for securing the club shafts, the length of the slot being substantially greater than its width and the width of the slot being greater than a single club's narrow region and less than a single club's wider region;

said plate and arm each having a first connecting portion and a second connecting portion, said first connecting portions comprising locking means for releasably locking said first connecting portions together when said plate and arm are arranged in said engaged position;

means for joining said second connecting portions when said plate and arm are arranged in said engaged position; and a cable permanently attached at one of its ends to the security device and having a loop at its other end for receiving a padlock shackle, said cable being substantially longer than the distance from said one end to said first connecting portions, whereby the cable may be wrapped around a fixed object and attached to said first connecting portions by the padlock.

21. In combination with a generally tubular golf club bag having an open mouth at one end thereof and a plurality of golf clubs disposed in said bag and extending through said open mouth, each golf club having a head disposed at the end of a shaft, the shaft having a narrow region near the head and a wider region farther from the head, a security device arranged in an engaged position about the shafts of said clubs between their respective heads and wider regions, said security device comprising:

a plate and arm shaped for cooperative engagement so that, when arranged in said engaged position, portions of their respective perimeters mutually define a through-cut slot closed at each end for securing the club shafts, the length of the slot being substantially greater than its width and the width of the slot being greater than a single club's narrow region and less than a single club's wider region;

said plate and arm each having a first connecting portion and a second connecting portion, said first connecting portions comprising locking means for releasably locking said first connecting portions together when said plate and arm are arranged in said engaged position;

means for joining said second connecting portions when said plate and arm are arranged in said engaged position; and a cable permanently attached at one of its ends to the security device and having a loop at its other end for receiving a padlock shackle, said cable being substantially longer than the distance from said one end to said first connecting portions, whereby the cable may be wrapped around a fixed object and attached to said first connecting portions by the padlock.

22. A method for securing golf clubs, comprising the steps of:

providing a generally tubular golf club bag having an open mouth at one end thereof and a plurality of golf clubs disposed in said bag and extending through said open mouth, each golf club having a head disposed at the end of a shaft, the shaft having a narrow region near the head and a wider region farther from the head;

providing a security device comprising a plate and arm shaped for cooperative engagement so that, when arranged in said engaged position, portions of their respective perimeters mutually define a through-cut slot closed at each end for securing the club shafts, the length of the slot being substantially greater than its width and the width of the slot being greater than a single club's narrow region and less than a single club's wider region, said plate and arm each having a first connecting portion and a second connecting portion, said first connecting portions comprising locking means for releasably locking said first connecting portions together when said plate and arm are arranged in said engaged position, said plate comprising a plurality of tongues connected at one end of the plate and extending therefrom so as to define a number of said slots equal to one less than the number of tongues, said arm connecting the ends of at least two of said tongues when arranged in its engaged position, said security device further comprising means for joining said second connecting portions when said plate and arm are arranged in said engaged position;

arranging said security device in said engaged position about the shafts of said clubs between their respective heads and wider regions; and locking said locking means so as to secure said clubs together within said security device.

23. A method for securing golf clubs, comprising the steps of:

providing a generally tubular golf club bag having an open mouth at one end thereof and a plurality of golf clubs disposed in said bag and extending through said open mouth, each golf club having a head disposed at the end of a shaft, the shaft having a narrow region near the head and a wider region farther from the head;

providing a security device comprising a plate and arm shaped for cooperative engagement so that, when arranged in said engaged position, portions of their respective perimeters mutually define a through-cut slot closed at each end for securing the club shafts, the length of the slot being substantially greater than its width and the width of the slot being greater than a single club's narrow region and less than a single club's wider region, said plate and arm having a first connecting portion and a second connecting portion, said first connecting portions comprising locking means for releasably locking said first connecting portions together when said plate and arm are arranged in said engaged position, said security device further comprising means for joining said second connecting portions when said plate and arm are arranged in said engaged position, and a cable permanently attached at one of its ends to the security device and having a loop at its other end for receiving a padlock shackle, said cable being substantially longer than the distance from said one end to said first connecting portions;

arranging said security device in said engaged position about the shafts of said clubs between their respective heads and wider regions;

wrapping said cable around a fixed object; and locking said locking means so as to retain said cable loop and secure said clubs together within said security device.

* * * * *